US005437343A

United States Patent [19]

Cooley et al.

[11] Patent Number: 5,437,343

[45] Date of Patent: Aug. 1, 1995

[54] DIAMOND CUTTERS HAVING MODIFIED CUTTING EDGE GEOMETRY AND DRILL BIT MOUNTING ARRANGEMENT THEREFOR

[75] Inventors: Craig H. Cooley, Bountiful; Jeffrey B. Lund; Redd H. Smith, both of Salt Lake City, all of Utah

[73] Assignee: Baker Hughes Incorporated, Houston, Tex.

[21] Appl. No.: 893,704

[22] Filed: Jun. 5, 1992

[51] Int. Cl.[6] ..... E21B 10/46

[52] U.S. Cl. ..... 175/431; 175/434

[58] Field of Search ..... 175/428, 429, 430, 431

[56] References Cited

U.S. PATENT DOCUMENTS

| | | | |
|---|---|---|---|
| Re. 32,036 | 11/1985 | Dennis . | |
| 4,109,737 | 8/1978 | Bovenkerk . | |
| 4,558,753 | 12/1983 | Barr | 175/431 |
| 4,592,433 | 6/1986 | Dennis | 175/428 |
| 4,607,711 | 8/1986 | Zijsling | 175/428 |
| 4,682,663 | 7/1987 | Daly et al. | 175/431 |
| 4,792,001 | 12/1988 | Zijsling | 175/428 |
| 4,858,707 | 8/1989 | Jones et al. | 175/431 |
| 4,987,800 | 1/1991 | Gasan et al. . | |
| 5,016,718 | 5/1991 | Tandberg . | |
| 5,131,481 | 7/1992 | Smith | 175/428 |

FOREIGN PATENT DOCUMENTS 2193740 2/1988 United Kingdom .

OTHER PUBLICATIONS

Grandia, et al, *Diamond Tool-Tip for Ultrasonic Drilling*, IBM Technical Disclosure Bulletin, vol. 13. No. 11, Apr. 1971, p. 3285.

*Primary Examiner*—Ramon S. Britts
*Assistant Examiner*—Frank S. Tsay
*Attorney, Agent, or Firm*—Trask, Britt & Rossa

[57] ABSTRACT

A diamond cutting element including a substantially planar diamond table having a periphery defined by a multiple chamfer. The angle of the outermost chamfer may be oriented to provide a bearing surface on the cutting element at the place of engagement with the formation being drilled.

20 Claims, 1 Drawing Sheet

DIAMOND CUTTERS HAVING MODIFIED CUTTING EDGE GEOMETRY AND DRILL BIT MOUNTING ARRANGEMENT THEREFOR

BACKGROUND OF THE INVENTION

1. Field of the Invention

The present invention relates generally to superhard material cutting elements for earth boring drill bits, and specifically to modifications to the geometry of the peripheral cutting edge of such cutting elements.

2. State of the Art

Superhard cutting elements in the form of Polycrystalline Diamond Compact (PDC) structures have been commercially available for approximately two decades, and planar PDC cutting elements for a period in excess of 15 years. The latter type of PDC cutting elements commonly comprises a thin, substantially circular disc (although other configurations are available) including a layer of superhard material formed of diamond crystals mutually bonded under ultrahigh temperatures and pressures and defining a planar front cutting face, a planar rear face and a peripheral or circumferential edge, at least a portion of which is employed as a cutting edge to cut the subterranean formation being drilled by a drill bit on which the PDC cutting element is mounted. PDC cutting elements are generally bonded during formation to a backing layer or substrate formed of tungsten carbide, although self-supporting planar PDC cutting elements are also known, particularly those stable at higher temperatures, which are known as TSP's, or Thermally Stable Products.

Either type of PDC cutting element is generally fixedly mounted to a rotary drill bit, generally referred to as a drag bit, which cuts the formation substantially in a shearing action through rotation of the bit and application of drill string weight thereto. A plurality of either, or even both, types of PDC cutting elements is mounted on a given bit, and cutting elements of various sizes may be employed on the same bit.

Drag bits may be cast and/or machined from metal, typically steel, or may be formed of a powder metal infiltrated with a liquid binder at high temperatures to form a matrix. PDC cutting elements may be brazed to a matrix-type bit after furnacing, or TSP's may even be bonded into the bit body during the furnacing process. Cutting elements are typically secured to cast or machined (steel body) bits by preliminary bonding to a carrier element, commonly referred to as a stud, which in turn is inserted into an aperture in the face of the bit and mechanically or metallurgically secured thereto. Studs are also employed with matrix-type bits, as are cutting elements secured via their substrates to cylindrical carrier elements affixed to the matrix.

It has long been recognized that PDC cutting elements, regardless of their method of attachment to drag bits, experience relatively rapid degradation in use due to the extreme temperatures and high loads, particularly impact loading, as the bit drills ahead downhole. One of the major observable manifestations of such degradation is the fracture or spalling of the PDC cutting element cutting edge, wherein large portions of the superhard PDC layer separate from the cutting element. The spalling may spread down the cutting face of the PDC cutting element, and even result in delamination of the superhard layer from the backing layer of substrate or from the bit itself if no substrate is employed. At the least, cutting efficiency is reduced by cutting edge damage, which also reduces the rate of penetration of the drill bit into the formation. Even minimal fracture damage can have a negative effect on cutter life and performance. Once the sharp corner on the leading edge (taken in the direction of cutter movement) of the diamond table is chipped, the amount of damage to the table continually increases, as does the normal force required to achieve a given depth of cut. Therefore, as cutter damage occurs and the rate of penetration of the drill bit decreases, the standard rig-floor response of increasing weight on bit quickly leads to further degradation and ultimately catastrophic failure of the chipped cutting element.

It has been recognized in the machine-tool art that chamfering of a diamond tool tip for ultrasonic drilling or milling reduces splitting and chipping of the tool tip. J. Grandia and J. C. Marinace, "DIAMOND TOOL-TIP FOR ULTRA-SONIC DRILLING"; IBM Technical Disclosure Bulletin Vol. 13, No. 11, April 1971, p. 3285. Use of bevelling or chamfering of diamond and cubic boron nitride compacts to alleviate the tendency toward cutter edge chipping in mining applications was also recognized in U.K. Patent Application GB 2193749 A.

U.S. Pat. No. 4,109,737 to Bovenkerk discloses, in pertinent part, the use of pin- or stud-shaped cutting elements on drag bits, the pins including a layer of polycrystalline diamond on their free ends, the outer surface of the diamond being configured as cylinders, hemispheres or hemisphere approximations formed of frustoconical flats.

U.S. Pat. No. Re. 32,036 to Dennis discloses the use of a bevelled cutting edge on a disc-shaped, stud-mounted PDC cutting element used on a rotary drag bit.

U.S. Pat. No. 4,987,800 to Gasan, et al. references the aforementioned Dennis reissue patent, and offers several alternative edge treatments of PDC cutting elements, including grooves, slots and pluralities of adjacent apertures, all of which purportedly inhibit spalling of the superhard PDC layer beyond the boundary defined by the groove, slot or row of apertures adjacent the cutting edge.

Finally, U.S. Pat. No. 5,016,718 to Tandberg discloses the use of planar PDC cutting elements employing an axially and radially outer edge having a "visible" radius, such a feature purportedly improving the "mechanical strength" of the element.

In summary, it appears that if the initial chipping of the diamond table cutting edge can be eliminated, the life of a cutter can be significantly increased. Modification of the cutting edge geometry was perceived to be a promising approach to reduce chipping, but has yet to realize its full potential in prior art configurations.

SUMMARY OF THE INVENTION

The present invention provides an improved, multiple chamfer cutting edge geometry for superhard cutting elements. Such a configuration or geometry provides excellent fracture resistance combined with cutting efficiency generally comparable to standard (unchamfered) cutting elements.

While the present invention is disclosed herein in terms of preferred embodiments employing PDC cutting elements, it is believed to be equally applicable to other superhard materials such as boron nitride, silicon nitride and diamond films.

In one preferred embodiment of the invention, the angle of the outermost chamfer at the periphery of the superhard cutting element to the side edge of the cutting element substantially approximates the backrake angle of the cutting element on the face of the drill bit. Stated another way, the cutting element may be oriented on the bit face so that the surface of the outermost chamfer rides on the formation being drilled to provide an increased bearing surface or load area to absorb normal forces on the cutting element.

DETAILED DESCRIPTION OF THE PREFERRED EMBODIMENTS

It has been established that chamfering or bevelling of the cutting edge or cutting face periphery of a planar PDC cutting element does, in fact, reduce, if not prevent, edge chipping, a phenomenon which apparently promotes cutting element failure due to fracturing. It has been discovered that radiused cutter edges also greatly enhance chip resistance of the cutting edge. However, testing has confirmed that the degree of benefit derived from chamfering or radiusing the edge of the diamond table of a cutting element is extremely dependent on the dimension of the chamfer or the radius. In measuring a chamfer, the dimension is taken perpendicularly, or depth-wise, from the front of the cutting face to the point where the chamfer ends. For a radiused edge, the reference dimension is the radius of curvature of the rounded edge. To provide the desired, beneficial anti-chipping effect, it has been established that the chamfer or the radius on the edge of the diamond table must be relatively large, on the order of 0.040–0.045 inches. Smaller chamfers and edge radii, on the order of 0.015–0.020 inches, are somewhat less effective in providing fracture resistance in comparison to the larger dimension chamfers and radii, even though the former provide more fracture resistance than standard, sharp-edged cutters. This deficiency of smaller chamfer and radius cutting elements is particularly noticeable under repeated impacts such as those to which cutting elements are subjected in real world drilling operations.

The discovery that chamfers and radii are dimensional-dependent in their anti-chipping effectiveness was somewhat discouraging and presented a major barrier to the economical implementation of chamfered or radiused PDC cutting elements. For example, producing a large chamfer requires extended grinding time and unacceptable material usage (grinding wheel consumption). Producing a large-radiused cutting edge not only consumes time, but requires precision grinding techniques and equipment to maintain the desired curvature within a reasonable tolerance, and to ensure that the curved edge terminates tangentially to both the cutting element face and side.

The inventors herein have discovered that a PDC cutting element may be fabricated to possess a much greater resistance to chipping, spalling and fracturing of the diamond table than a standard PDC element without the inordinate expense and effort required to produce a large chamfer or a large radius at the edge of the diamond table.

Figure 1:
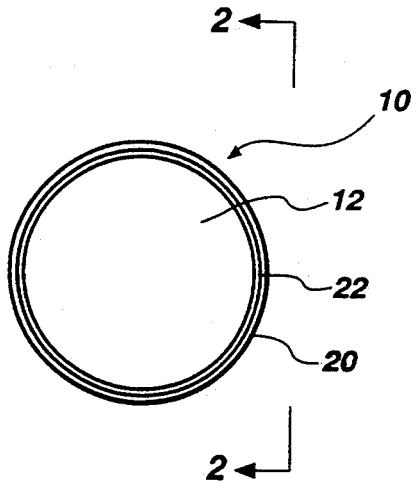
FIG. 1 is a front element of a round PDC cutting element according to the present invention.
Figure 2:
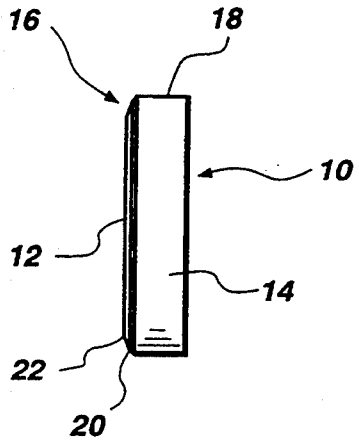
FIG. 2 is a side elevation of the cutting element of FIG. 1, taken across lines 2—2.

Specifically, referring to FIGS. 1 and 2 of the drawings, the PDC cutting element 10, in accordance with the present invention, includes a substantially planar diamond table 12, which may or may not be laminated to a tungsten carbide substrate 14 of the type previously described. The diamond table 12 may be of circular configuration as shown, be of half-round or tombstone shape, comprise a larger, non-symmetrical diamond table formed from smaller components or via diamond film techniques, or comprise other configurations known in the art or otherwise. Outer periphery 16 of diamond table 12 ("Outer" indicating the edge of the cutting element which engages the formation as the bit rotates in a drilling operation) is of a double chamfer configuration, including outer chamfer 20 and contiguous inner chamfer 22, as may be more easily seen in FIG. 2. If a substrate 14 is used, periphery 16 is usually contiguous with the side 18 of substrate 14, which in turn is usually perpendicular to the plane of the diamond table 12.

In the example of FIGS. 1 and 2, the chamfered surfaces 20 and 22 depart at acute angles from the orientation of the cutting element edge or periphery 16, which (in a conventional PDC cutting element) is normally perpendicular or at 90° to the plane of diamond table 12. Surfaces 20 and 22 are disposed at angles $\alpha$ and $\beta$, respectively, and define depths $D_1$ and $D_2$ of the total thickness of the diamond table 12, all as more clearly depicted in the enlarged side view of periphery 16 in FIG. 3.

Normally, PDC diamond tables are of a thickness or depth of 0.030–0.040 inches, and many widely employed PDC cutting elements utilize a nominal diamond table thickness of 1 mm or 0.039 inches. In the case of such cutting elements, it has been found that an angle $\alpha$ of 20° and an angle $\beta$ of 45° to the extended line of orientation of cutting element periphery 16 is easily and quickly achieved by grinding standard cutters as received from the factory. Depth $D_1$ of the diamond table 12 chamfered at angle $\alpha$ is 0.020 inches, while depth $D_2$ of that portion of diamond table 12 chamfered at angle d is 0.010 inches, leaving an unchamfered depth of approximately 0.009 inches adjacent substrate 14. In practice, the chamfered area may comprise the entire periphery 16, so that no unchamfered depth of diamond table 12 remains. In such instances, the angles $\alpha$ and $\beta$ are measured from a line perpendicular to the face of the diamond table 12 adjacent the periphery 16.

It has been found in testing that cutters so modified are substantially as fracture resistant as cutters with large (0.040 inch) radii or chamfers, yet far more economical to produce than of these edge configurations either. Similarly, double-chamfered cutters are much more fracture resistant than cutters with small (0.015 inch) radii and chamfers.

Figure 3:
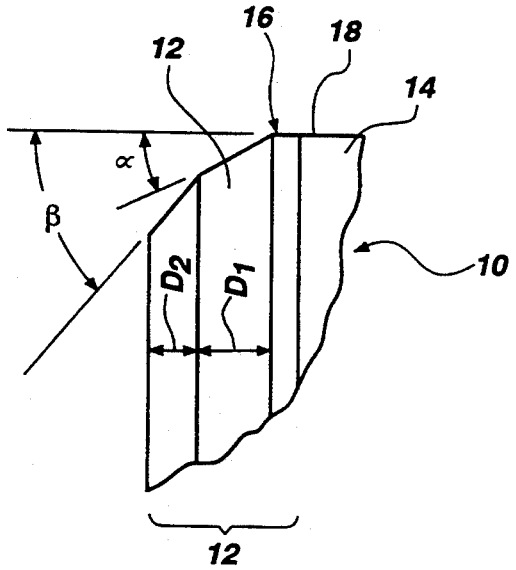
FIG. 3 is an enlarged side elevation of the outer periphery of the cutting element of FIG. 1 from the same perspective as that of FIG. 2.

It is believed that stress risers at the sharp-angled periphery of a standard cutting element diamond table are at least to some degree responsible for chipping and spalling. While radiusing of the diamond table edge eliminates the angled edge, as noted previously, the large radius required for effective chip, spall and fracture resistance is achieved at an unacceptable cost. The double-chamfer design depicted in FIGS. 1–3 is believed (and has been demonstrated) to exhibit the same resistance to impact-induced destruction as the large radius approach, apparently reducing the diamond table edge stress concentration below some threshold level.

The aforementioned chipping and spalling of diamond tables comprise the two most common modes of fracturing, and have been demonstrated to be caused by different types of loading. Chipping primarily results from horizontal or tangential loading of a cutting element, attributable to rotation of the bit on which the cutting element is mounted, and the forces exerted on the face of the diamond table as it moves in the radial plane to cut the formation being drilled. Spalling, on the other hand, primarily results from the normal forces applied to the cutting element arising from weight applied to the bit and aligned substantially parallel to the bit axis. The equivalent chipping and spalling resistance of multiple chamfer cutting elements, in accordance with the present invention to that of otherwise identical large radius or large (single) chamfer cutting elements, has been empirically demonstrated. Finite element analysis techniques have also indicated that the resistance of a double chamfer cutting element to chipping under tangential loading is superior to that of single chamfer cutting elements. The tensile loading of the diamond table from tangential forces is indicated numerically to result in a much higher stress concentration when applied to the cutting edge of a single chamfer cutting element than when an equal tangential load is applied to a double chamfer cutting edge.

Figure 5:
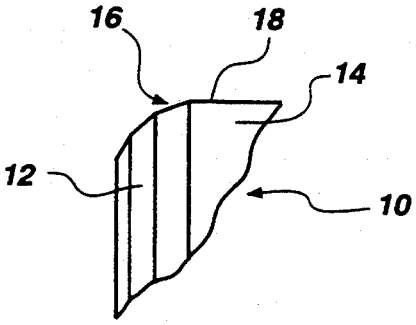
FIG. 5 is an enlarged side elevation of the outer periphery of a cutting element according to the invention with a triple chamfered edge.

It is also contemplated that a triple chamfer edge (see FIG. 5) would exhibit the same, if not better, characteristics as the double chamfer edge, and might in fact be less costly to fabricate as less material would need to be removed from the diamond table. Furthermore, a triple chamfer design closely approximates the beneficial but costly and difficult to implement large radius edge, and at a lower cost.

It has also been observed by the inventors herein that the capability of the PDC cutting element diamond table to sustain normal forces (those forces parallel to the axial direction of travel of the bit) is specifically enhanced by the use of the multiple chamfer design of the present invention. Stated another way, normal forces acting on the cutting elements are believed to be a major contributor to cutter fracture, and the multiple chamfer design of the present invention greatly increases a cutter's apparent resistance to normal force-induced fracture to an unexpected extent. In fact, it is believed that the multiple chamfer design enhances the ability of the cutting element to better withstand loads applied from a variety of directions.

Figure 4:
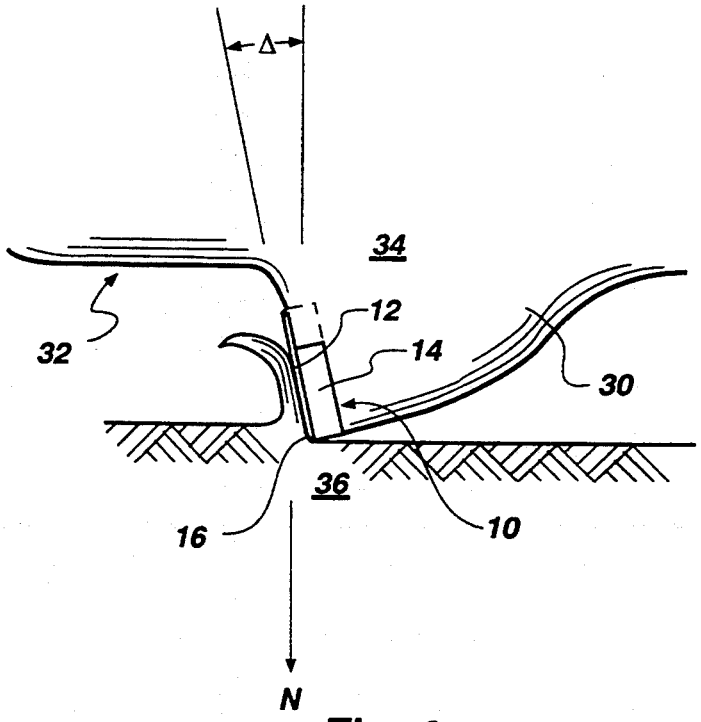
FIG. 4 is a side elevation of a PDC cutting element according to the present invention mounted on the face of a drill bit and in the process of cutting a formation.

FIG. 4 depicts a PDC cutting element 10 according to the present invention mounted on protrusion 30 of bit face 32 of a rotary drag bit 34. Drag bit 34 is disposed in a borehole so that periphery 16 of the diamond table 12 of PDC cutting element 10 is engaging formation 36 as bit 34 is rotated and weight is applied to the drill string to which bit 34 is affixed. It will be seen that normal forces N are oriented substantially parallel to the bit axis, and that the backracked PDC cutting element 10 is subjected to the normal forces N at an acute angle thereto. In the illustration of FIG. 4, PDC cutting element 10 is oriented at a backrake angle $\Delta$ of 15° which, if PDC cutting element 10 were of conventional, sharp-edged design, would be applied to the "corner" between the front and side of the diamond table and result in an extraordinarily high and destructive force concentration due to the minimal bearing area afforded by the point or line contact of the diamond table edge. However, PDC cutting element 10 as deployed on the bit of FIG. 4 includes an outer chamfer angle $\alpha$ of 15°, substantially the same as the backrake angle of the cutting element, so that the two angles effectively cooperate so that the surface of chamfer 20 provides a substantially planar bearing surface on which cutting element 10 rides. Thus, the loading per unit area is markedly decreased from the point or line contact of cutters with conventional 90° edges, a particular advantage when drilling harder formations. It will be recognized that it is not necessary to orient outer chamfer 20 parallel to the formation, so long as it is sufficiently parallel thereto that the weight on bit and formation plasticity cause the chamfer 20 to act as a bearing surface with respect to normal forces N. Outer chamfer 20 effectively increases the surface of the diamond table 12 "seen"by the formation and the Normal forces N, which are applied perpendicularly thereto, while the inner chamfer 22 at its greater angular departure from the edge of the PDC cutting element 10 provides a cutting edge which is effective at the higher depths of cut for which current drag bits are intended and which in prior art bits has proven highly destructive of new cutters.

A more sophisticated approach to matching cutter backrake and chamfer angle is also possible by utilizing "effective" backrake, which takes into account the radial position of the cutting element on the drill bit and the design rate or design range of rate of penetration to factor in the actual distance traveled by the cutter per foot of advance of the drill bit and thereby arrive at the true or effective backrake angle of a cutting element in operation. Such an exercise is relatively easy with the computational power available in present-day computers, but may in fact not be necessary so long as the chamfer utilized in a bit is matched to the apparent backrake angle of a stationary bit where stud-type cutters are employed. However, where cutter pockets are cast in a matrix-type bit, such individual backrake computations and grinding of matching chamfer angles on each cutter may be employed as part of the normal manufacturing process.

Fabrication of PDC cutting elements (including TSP elements) in accordance with the present invention may be easily effected through use of a diamond abrasive or electro-discharge grinding wheel and an appropriate fixture on which to mount the cutting element and, in the case of circular or partially round elements, to rotate them past the grinding wheel.

For optimum performance of the present invention with cutting elements having 1 mm or 0.039 inch thick diamond tables, it is believed that the outer chamfer 20 should be of a depth of at least about 0.020 inches, while the inner chamfer 22 should reach a depth of 0.010 inches. However, such dimensional recommendations are not hard and fast, and are somewhat dependent upon the nature of the diamond table and the fabrication technique employed to manufacture same.

Furthermore, while the invention has been described in terms of a planar diamond table, it should be recognized that the term "planar" contemplates and includes convex, concave and otherwise nonlinear diamond tables, which nonetheless comprise a diamond layer which can present a cutting edge at its periphery. In addition, the invention is applicable to diamond tables of other than PDC structure, such as diamond films, as well as other superhard materials such as cubic boron nitride and silicon nitride.

Moreover, it must be understood that chamfering is of equal benefit to straight or linear cutting edges as well as arcuate edges such as are illustrated and described herein.

Finally, it should be recognized and acknowledged that the multiple chamfer cutting edge of the present invention will be worn off of the diamond table as the bit progresses in the formation and a substantially linear "wear flat" forms on the cutting element. However, the intent and purpose of the present invention is to protect the new, unused diamond table against impact destruction until it has worn substantially from cutting the formation, after which point it has been demonstrated that the tendency of the diamond table to chip and spall has been markedly reduced.

While the cutting element, alone and in combination with a specific cooperative mounting orientation on a drill bit, has been disclosed herein in terms of certain preferred embodiments, these are exemplary only and the invention is not so limited. It will be appreciated by those of ordinary skill in the art that many additions, deletions and modifications to the invention may be made without departing from the scope of the claims.

What is claimed is:

1. A cutting element for use on a rotary drag bit for drilling subterranean formations, comprising:

a substantially planar table of superhard material having a face, a side and a peripheral edge between said face and said side, said peripheral edge being defined at least in part by:

a first, outer chamfer adjacent said side and oriented at a first acute angle to a line perpendicular to the plane of said table adjacent said peripheral edge; and a second, inner chamfer contiguous with said first, outer chamfer and oriented at a second, greater acute angle to said line than said first, outer chamfer.

2. The cutting element of claim 1, wherein said peripheral edge is arcuate.

3. The cutting element of claim 1, wherein said cutting element includes a supporting substrate affixed to said table of superhard material opposite said face.

4. The cutting element of claim 1, wherein said superhard material comprises diamond material.

5. The cutting element of claim 4, wherein said diamond material comprises a PDC.

6. A rotary drag bit for drilling subterranean formation, comprising:

a bit body having a longitudinal axis, including a face and having a shank secured thereto for affixing said bit to a drill string;

a plurality of cutting elements mounted on said bit face, at least one of said cutting elements comprising a substantially planar table of superhard material including a face, a side and a periphery therebetween, at least a portion of said periphery being defined by substantially contiguous first and second chamfers;

said first chamfer lying between said second chamfer and said side and being oriented at a first acute angle to a line perpendicular to said face adjacent said periphery; and said second chamfer lying between said first chamfer and said face and being oriented at a second, greater acute angle to said line than said first chamfer.

7. The rotary drag bit of claim 6, wherein the first acute angle of said first chamfer with respect to said line is approximately the same as the angle which said table forms with respect to said longitudinal axis of said bit.

8. The rotary drag bit of claim 6, wherein said table of superhard material comprises a diamond table.

9. The rotary drag bit of claim 8, wherein said diamond table comprises a PDC table.

10. A cutting element for use on a rotary drag bit for drilling subterranean formations, comprising:

a substantially planar table of superhard material having a cutting face on one side thereof, said cutting face having a peripheral edge defined by at least first inner and second outer substantially contiguous chamfered surfaces.

11. The cutting element of claim 10, further including a supporting substrate affixed to said table on a side thereof opposite said cutting face.

12. The cutting element of claim 10, wherein said chamfered surfaces extend from said cutting face to the opposite side of said table.

13. The cutting element of claim 10, wherein said table is affixed to a carrier element adapted to be secured to the face of a drill bit.

14. The cutting element of claim 10, wherein said table of superhard material comprises diamond.

15. The cutting element of claim 14, wherein said diamond table comprises a polycrystalline diamond compact.

16. The diamond cutting element of claim 14, wherein said diamond table comprises thermally stable polycrystalline diamond.

17. A rotary drag bit for drilling a subterranean formation, comprising:

a bit body having a face carrying a plurality of cutting elements thereon, at least some of which cutting elements comprise tables of superhard material each having a cutting edge along a periphery thereof comprised of multiple chamfers, one of said multiple chamfers being peripherally outermost; and at least one of said superhard material tables being oriented on said bit face so as to provide, on said outermost of said multiple chamfers on said cutting edge, a bearing surface for said at least one superhard material table to ride on said formation during said drilling thereof.

18. The rotary drag bit of claim 17, wherein said superhard material comprises diamond material.

19. The rotary drag bit of claim 18, wherein said diamond material comprises a polycrystalline diamond compact.

20. The rotary drag bit of claim 18, wherein said diamond material comprises thermally stable polycrystalline diamond.

* * * * *

UNITED STATES PATENT AND TRADEMARK OFFICE

CERTIFICATE OF CORRECTION

PATENT NO. : 5,437,343

DATED : August 1, 1995

INVENTOR(S) : Cooley et al.

It is certified that error appears in the above-indentified patent and that said Letters Patent is hereby corrected as shown below:

In Column 4, line 52, change "d" to --$\beta$--;

In Column 4, line 62, after "than" insert --either--;

In Column 4, line 63, delete "either";

In Column 7, lines 35-36, delete the space between the end of line 35 and the beginning of line 36; and In Column 7, line 58, change "tion" to --tions--.

Signed and Sealed this

Ninth Day of April, 1996

Bruce Lehman

*Attest:*

BRUCE LEHMAN

*Attesting Officer*

*Commissioner of Patents and Trademarks*